United States Patent [19]

Telfer

[11] Patent Number: 4,714,013

[45] Date of Patent: Dec. 22, 1987

[54] COLLAPSIBLE COOKING UNIT

[76] Inventor: Terrence D. Telfer, 64 NW. Portland Ave., Bend, Oreg. 97701

[21] Appl. No.: 935,275

[22] Filed: Nov. 26, 1986

[51] Int. Cl.[4] ..... F24C 1/16; B65D 6/12

[52] U.S. Cl. ..... 99/449; 99/444; 126/9 R; 16/110 A; 220/6

[58] Field of Search ..... 99/449, 444; 126/9 R, 126/9 A, 9 B, 25 R; 220/6; 16/110 A

[56] References Cited

U.S. PATENT DOCUMENTS

| | | | |
|---|---|---|---|
| 1,238,142 | 8/1917 | Hitchcock . | |
| 1,403,842 | 1/1922 | Chambers et al. . | |
| 1,651,818 | 12/1927 | Gorrell . | |
| 1,673,769 | 6/1928 | Graham | 220/6 |
| 1,972,483 | 9/1934 | Hartson | 220/6 |
| 2,469,885 | 5/1949 | Molla | 126/144 |
| 3,109,420 | 11/1963 | Ott et al. | 126/9 R |
| 3,194,429 | 7/1965 | Bovet | 99/449 X |
| 3,384,066 | 5/1968 | Tufts | 126/9 R |
| 3,601,280 | 8/1971 | Mills | 99/444 X |
| 3,667,446 | 6/1972 | Morton | 126/9 R |
| 3,682,154 | 8/1972 | Mollere | 126/9 A |
| 3,698,376 | 10/1972 | Webb | 126/9 R |
| 3,812,997 | 5/1974 | McNally | 16/110 A |
| 4,140,099 | 2/1979 | Newport | 126/9 A |
| 4,149,514 | 9/1979 | Latouf | 126/9 R |
| 4,204,516 | 5/1980 | Figura | 126/9 R |
| 4,211,206 | 7/1980 | Darbo | 99/449 X |
| 4,254,863 | 3/1981 | Katcs et al. | 206/216 |
| 4,455,992 | 6/1984 | Hsiao | 126/9 R |
| 4,489,706 | 12/1984 | Hait | 126/9 R |
| 4,508,094 | 4/1985 | Hait | 126/9 R |
| 4,545,359 | 10/1985 | Hait | 126/9 R |

FOREIGN PATENT DOCUMENTS

| | | |
|---|---|---|
| 136398 | 8/1948 | Australia . |

*Primary Examiner*—Louis K. Rimrodt
*Assistant Examiner*—J. L. Olds
*Attorney, Agent, or Firm*—Jack M. Wiseman

[57] ABSTRACT

A cooking unit formed with four side panels hinged along adjacent sides. A pair of opposite side panels are hinged between the sides thereof in parallel relation to the hinges joining the adjacent sides thereof. The cooking unit in an extended state is hollow, and in cross-section has a rectangular or square configuration.

7 Claims, 14 Drawing Figures fig_4
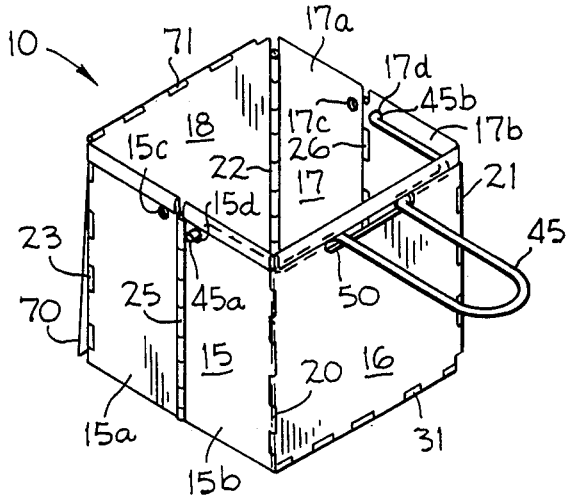
fig_5
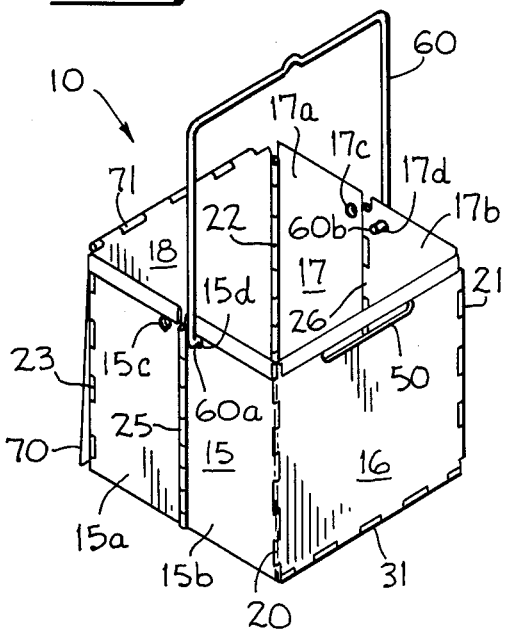
fig_6
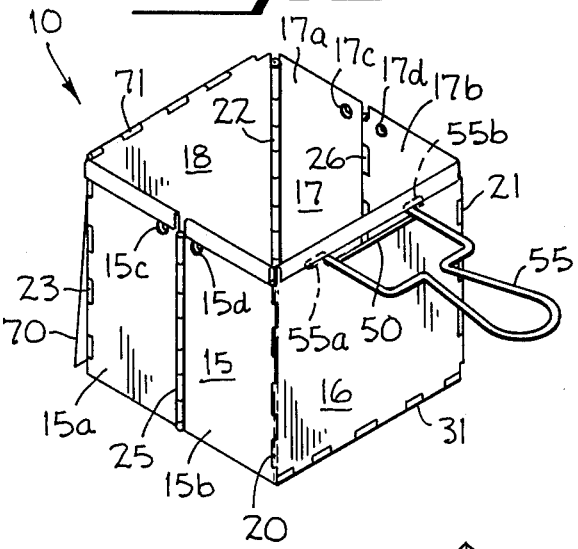
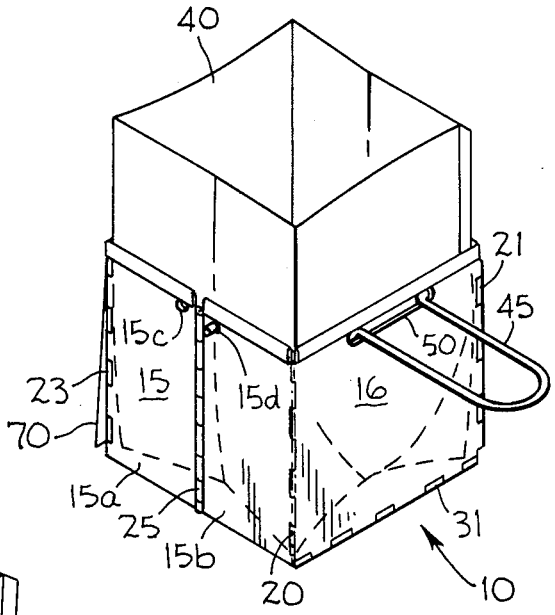
fig_7
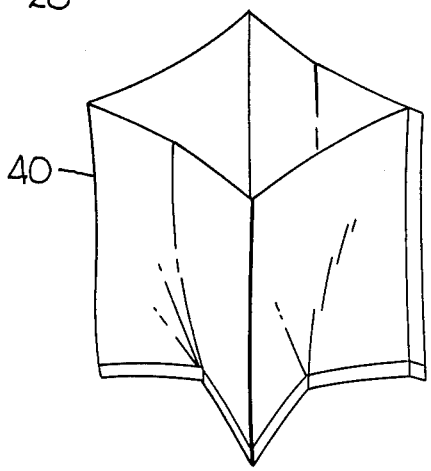
fig_8

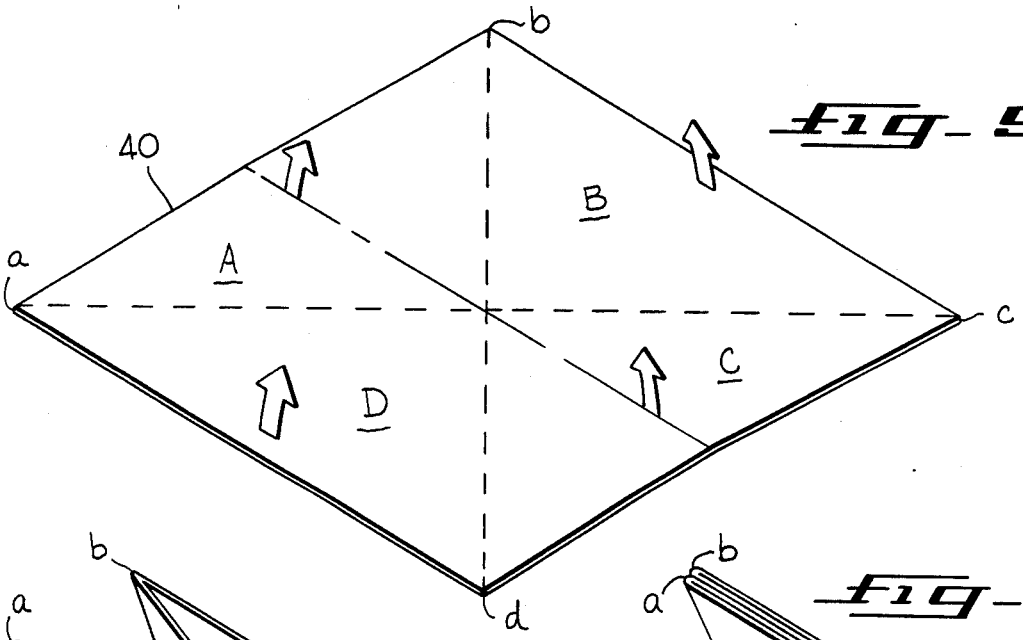
fig_9A
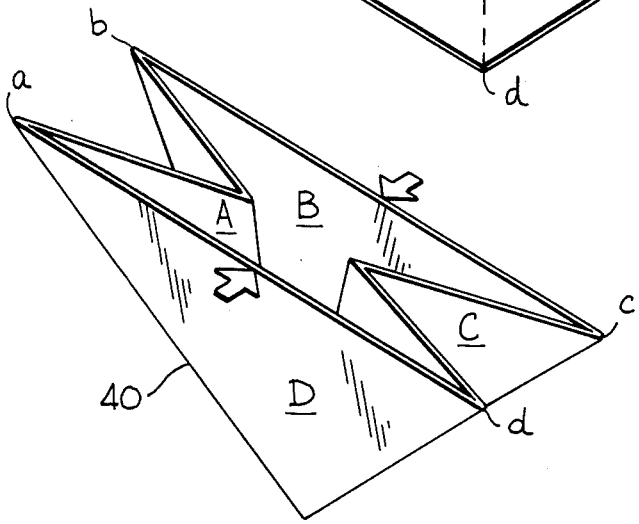
fig_9B
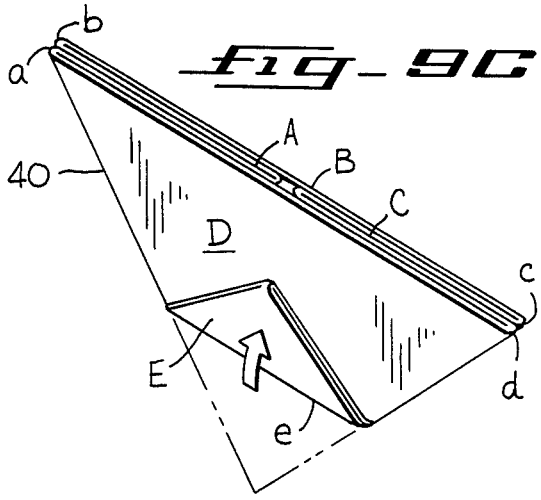
fig_9C
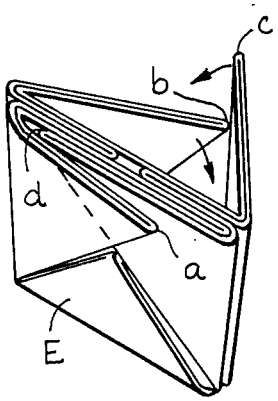
fig_9D
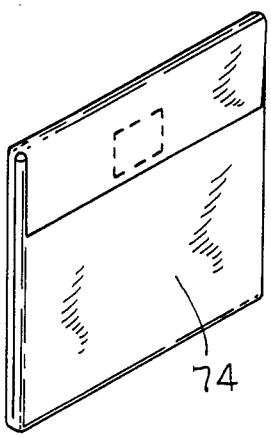
fig_10
fig_11
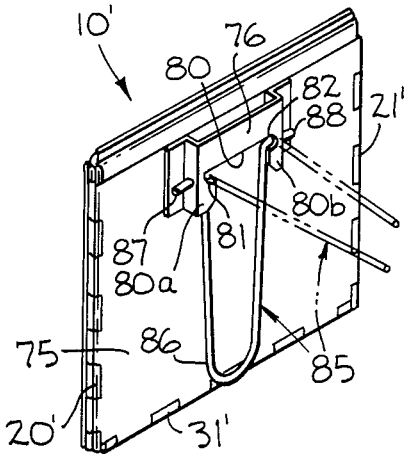

COLLAPSIBLE COOKING UNIT

BACKGROUND OF THE INVENTION

The present invention relates in general to outdoor cooking units, and more particularly to a collapsible cooking unit that is compact and portable.

In certain environments, it is desirable that outdoor cooking units be versatile when extended for cooking, be compact when transported and stored, and be durable. Outdoor cooking units of this type find utility among backpackers, campers, hikers and military personnel.

The to Hitchcock, U.S. Pat. No. 1,238,142, issued on Aug. 28, 1917, for a Collapsible Campers' Stove discloses a collapsible camping stove having a truncated pyramidal configuration in which the panels thereof are hinged at the adjacent sides thereof. A hinged cover is pivotally joined to the upper end of one panel and seats along the upper ends of the remaining panels.

In the Latouf, U.S. Pat. No. 4,149,514, issued on Apr. 17, 1979, for Barbeque Burner, there is disclosed a barbeque burner having an inverted, truncated pyramidal configuration. The burner comprises panels in which the contiguous sides thereof are hinged together. One panel includes an opening at the top thereof for the insertion of fuel. The opposite panel is hinged intermediate the sides thereof. A bottom wall is hinged to the one panel and removably secured to the opposite panel. A grill seats along the upper ends of the panels.

The Tufts, U.S. Pat. No. 3,384,066, issued on May 31, 1968, for Charcoal Burner discloses a foldable sheet metal charcoal burner having a truncated, pyramidal configuration. The charcoal burner includes panels in which draft openings are formed. Adjacent sides of the panels are joined by hinges. A grate is removably supported by the panels by means of curved hooks and slots. A rod releasably supports an end of grate opposite from the hinged connection. A removable grill is supported by the panels. Food or a container of water is heated by placement on the grill. A lifting bail is removably inserted in openings formed in opposite panels for lifting the burner.

The Hait, U.S. Pat. No. 4,508,094, issued on Apr. 2, 1985, for Convertible Cooking Unit discloses a cooking unit with a truncated pyramidal firebox and a similar support member that are disposed in telescoping relation. Side panels are hinged together at adjacent edges. A pair of opposite side panels are hinged intermediate the sides thereof.

In the Mollere, U.S. Pat. No. 3,682,154, issued on Aug. 8, 1972, for Portable Disposable Charcoal Grill, a portable and disposable charcoal grill is lined with aluminum foil. The grill is hollow and has a square cross-sectional area. The Mills, U.S. Pat. No. 3,601,280, issued on Aug. 24, 1971, for Disposable Aluminum Liner For Barbeque discloses a flexible fire-resistant disposable liner for a portable barbeque. The liner is made of aluminum. The Katcs et al., U.S. Pat. No. 4,254,863, issued on Mar. 10, 1981, for Barbeque Pack discloses a disposable barbeque pack comprising a packaging container, an aluminum fire box, and a grid. The fire box and grid may be crumpled up manually so as to be disposable.

SUMMARY OF THE INVENTION

The cooking unit of the present invention comprises four side panels hinged along the juxtaposed sides thereof. A pair of opposite side panels are hinged intermediate the sides thereof in parallel relation to the hinges joining the juxtaposed sides thereof. The cooking unit in an extended state is hollow and in cross-section has a rectangular or square configuration. A bottom panel is hinged to the bottom edge of a side panel other than said pair of side panels. When the cooking unit is in an extended state, the bottom panel engages the inner walls of the side panels, other than the side panel to which it is hinged, in a snug relation. A top panel is hinged to the upper edge of the side panel opposite to the side panel to which the bottom panel is hinged. When the cooking unit is in an extended state, the top panel seats on the top edges of the side panels other than the side panel to which it is hinged.

An object of the present invention is to provide a versatile and compact cooking unit adaptable for use by campers, backpackers and military personnel for heating food and a vessel containing a liquid.

Another object of the present invention is to provide a cooking unit that is collapsible into a compact package for convenient portability and storage.

Another object of the present invention is to provide a cooking unit that is simple and sturdy in its construction, convenient in its assembly, and dependable in its operation.

A feature of the present invention are the ends of the bail wire handle, which are turned generally perpendicular toward a center line and are received by the opposite openings, respectively, formed in the opposite side panels of the cooking unit. The bail wire handle may be oriented vertically so that the cooking unit may be suspended by the handle.

Another feature of the present invention are the ends of a bail wire handle, which are oppositely and outwardly directed. By squeezing the ends of the bail wire handle toward one another, the ends of the bail wire handle are inserted into the horizontal slot formed in one of the side panels. The bail wire handle is horizontally disposed and when released provides a handle projecting outwardly from the side panel in which the horizontal slot is formed. The horizontally disposed bail wire handle is adapted to be gripped by an operator from the side of the cooking unit.

Another feature of the present invention is the employment of a suitable liner for the cooking unit in order for the cooking unit to serve as a vessel for containing liquid.

DESCRIPTION OF THE DRAWINGS

FIG. 4 is a perspective view of the collapsible cooking unit shown in FIGS. 1–3, reduced in size, with the removable bail wire handle projecting through a slot formed in a side panel of the collapsible cooking unit to provide a handle for gripping the cooking unit from the side thereof.

FIG. 5 is a perspective view of a modification of the collapsible cooking unit shown in FIGS. 1–4, reduced in size, illustrating a bail wire handle with the free ends thereof directed inwardly.

FIG. 6 is a perspective view of another modification of the collapsible cooking unit shown in FIGS. 1–4, reduced in size, illustrating a removable bail wire handle projecting through the slot formed in the side panel of the collapsible cooking unit to provide a handle for gripping the cooking unit from the side thereof.

FIG. 7 is a perspective view of the collapsible cooking unit shown in FIGS. 1–4, reduced in size, with a disposable liner disposed therein.

FIG. 8 is a perspective view of the disposable liner shown in FIG. 7 illustrated in a partially extended state.

FIGS. 9A–9D are diagrammatic illustrations for forming the disposable liner shown in FIGS. 7 and 8.

FIG. 10 is a perspective view of a pouch for storing the collapsible cooking unit shown in FIGS. 1–4 when the cooking unit is in a collapsed state.

FIG. 11 is a perspective view of a further modification of the collapsible cooking unit shown in FIGS. 1–4, reduced in size, illustrating a bail wire handle pivotally and removably attached to a side panel of the collapsible cooking unit to provide a handle for gripping the cooking unit from the side thereof.

DETAILED DESCRIPTION OF THE PREFERRED EMBODIMENTS

Figures 1, 2, 3:
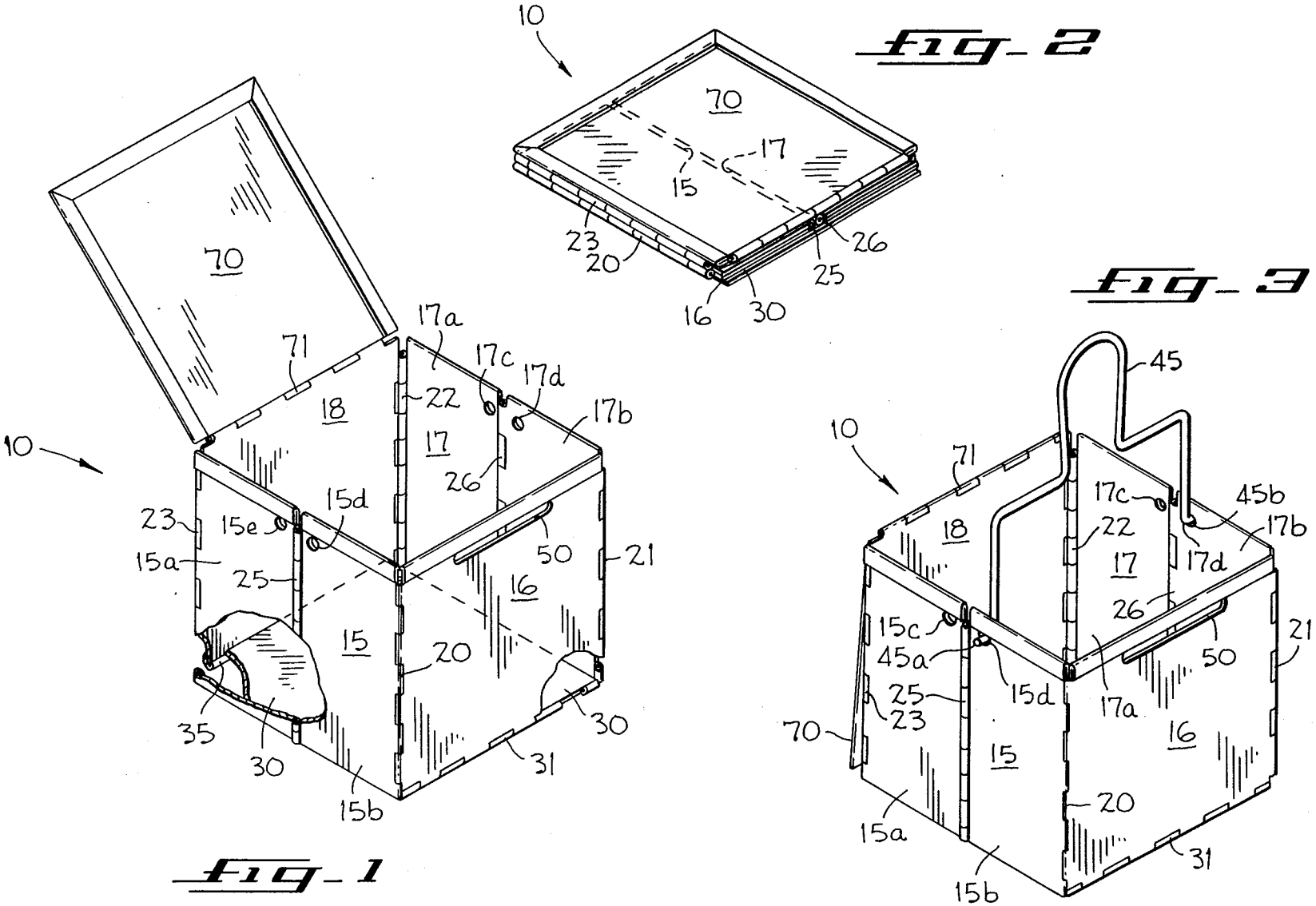
FIG. 1 is a perspective view of the collapsible cooking unit embodying the present invention shown in an extended state and broken away to illustrate the bottom panel thereof.
FIG. 2 is a perspective view of the collapsible cooking unit shown in FIG. 1 in a fully retracted or collapsed state.
FIG. 3 is a perspectiv view of the collapsible cooking unit shown in FIGS. 1 and 2 with a removable bail wire handle for suspending the cooking unit.

Illustrated in FIG. 1 is a collapsible cooking unit 10 embodying the present invention. The cooking unit 10 comprises four side panels 15–18. The side panels are preferably made of stainless steel and are hingedly joined to adjacent side panels along upright, contiguous side edges by suitable hinges, such as piano hinges 20–23. When the cooking unit 10 is in the extended state to be used for cooking, the cooking unit 10 is hollow and has a rectangular cross-sectional area. In the exemplary embodiment, the cross-sectional area of the extended cooking unit is square.

To facilitate the folding of the cooking unit 10 from an extended state to a compact, collapsed or folded state, opposing side panels, such as panels 15 and 17, are formed respectively midway between the sides thereof with hinged sections. The side panel 15 includes a piano hinge 25 that pivotally joins the hinged sections 15*a* and 15*b* thereof. Similarly, the side panel 17 includes a piano hinge 26 that pivotally joins the hinged sections 17*a* and 17*b* thereof.

A bottom panel 30 (FIG. 1), preferably made of stainless steel, is hingedly joined to a side panel, such as panel 16, along the bottom edge of the side panel by a suitable hinge, such as piano hinge 31. The side panel 16 to which the bottom panel 30 is hinged is other than the opposing side panels 15 and 17 having the hinges intermediate the sides thereof. Along the bottom edge of the side panel 18 is a flange 35 (FIG. 1), which extend inwardly of the cooking unit 10. When the cooking unit 10 is in the extended state, the bottom panel 30 seats on the flange 35 in abutting relation with the panels 15, 17 and 18. The bottom panel 30 serves as a brace for the side panels 16–18 to improve the sturdiness of the cooking unit 10. When the cooking unit 10 is folded to a retracted or collapsed state, the bottom panel 30 pivots inwardly about the hinge 31 away from the flange 35. In a fully retracted state, the bottom panel 30 is contiguous to the side panel 16. The bottom panel 30 is disposed above a flame or fuel to heat the contents of the fully extended cooking unit 10.

When it is desired to heat a liquid within the fully extended cooking unit 10, a disposable liner 40 (FIGS. 7 and 8) is unfolded into a bag configuration with a bottom wall and an open top. In the preferred embodiment, the liner 40 is made of a heavy duty metallic or aluminum foil laminated with a high temperature nylon film. The nylon film is sold by Reynolds Metals Company of Richmond, Virginia. The bottom wall of the liner 40 is disposed on the bottom panel 30 and the open end of the liner 40 extends upwardly adjacent to and in parallel relation with the side panels 15–18. Thus, the liner 40 engages the bottom panel 30 and the side panels 15–18. Liquid may be disposed in the liner 40 to be heated in the cooking unit 10.

Formed in the side panel 15 adjacent the top edge thereof are suitable openings 15*c* and 15*d*. Similarly, formed in the side panel 17 adjacent the top edge thereof are suitable openings 17*c* and 17*d*. For suspending the extended cooking unit 10, a removable bail wire handle 45 (FIG. 3) is provided. In one embodiment of the bail wire handle 45, the ends 45*a* and 45*b* thereof are aligned and are oppositely directed (FIG. 3). The ends 45*a* and 45*b* are insertable in aligned openings formed in the confronting side panels 15 and 17 (FIG. 3). In the exemplary panel, the aligned openings are formed in the side panels 15 and 17 which include the hinges midway between the ends thereof. The aligned openings define an axis about which the handle 45 rotates. From the ends 45*a* and 45*b* the bail wire handle 45 includes intermediate sections generally at right angles to the axis. The center of the bail wire handle 45 midway between its ends 45*a* and 45*b* form a loop or a Y-shaped or a U-shaped channel for suspending the handle 45 and thereby suspending the cooking unit 10.

Formed in the side panel 16 along the upper edge thereof is a horizontal slot 50 (FIGS. 3 and 4). When it is desired to have a handle projecting horizontally outward from the cooking unit so as to provide a handle extending from a side panel in a generally horizontal plane, the bail wire handle 45 is inserted at its central loop or channel through the horizontal slot 50 and then the ends 45*a* and 45*b* are flexed toward one another for entry into the aligned openings formed in the panels 15 and 17, and then released.

An alternative arrangement for providing a generally horizontally disposed handle that projects outwardly from a side panel comprises a removable bail wire handle 55 (FIG. 6). The ends 55*a* and 55*b* of the bail wire handle are oppositely directed. Projecting outwardly from the oppositely directed ends 55*a* and 55*b* at an acute angle or at a 90° angle are intermediate sections of the bail wire handle 55. A central portion of the bail wire handle 55 interconnect the intermediate sections thereof. To insert the bail wire handle 55 into the slot 50, the intermediate sections thereof are squeezed toward one another and the free ends 55*a* and 55*b* are inserted into the slot 50. Upon release of the intermediate sections, the free ends 55*a* and 55*b* engage the inner wall of the side panel 16 and the intermediate sections engage the walls at the end of the slot 50.

Illustrated in FIG. 5 is a modification of the cooking unit shown in FIG. 3 wherein a removable bail wire handle 60 has free ends 60*a* and 60*b* that are directed toward one another. The free ends 60*a* and 60*b* of the removable bail wire handle 60 are insertable into aligned openings formed in the confronting side panels 15 and 17. To insert the free ends 60*a* and 60*b* of the removable bail wire handle 60 into the aligned openings, the intermediate sections of the handle 60 are spread apart and the free ends 60*a* and 60*b* are inserted into the aligned openings in the panels 15 and 17. Thereupon, the intermediate sections of the handle 60 are released. Illustrated in FIG. 1 is a top panel 70 which is suitably hinged by a piano hinge 71 to a side panel, such as side panel 18, at the top edge thereof which is opposite to the side panel 16 to which the bottom panel 30 is hinged. The top panel 70, when the cooking unit is in an extended state, seats on the top edges of the remaining side panels 15, 16 and 17. The top panel 70, when seated on the side panels 15–17, serves as a lid or a cover. The removable liner 40 may be disposed within the cooking unit 10. The various bail wire handles may be used in a manner heretofore described for suspending the cooking unit or for gripping the cooking unit by means of a generally horizontal extension projecting from a side panel.

When the cooking unit 10 is folded to a retracted state, the bottom panel 30 pivots inwardly about the hinge 31 away from the flanges 35. The bottom panel 30 is adjacent the inside wall of the side panel 16. The top panel 70 is pivoted outwardly about the hinge 71 and is adjacent to the outer wall of the side panel 18.

In extending the cooking unit 10 for the use as a cooking unit from a collapsed state, the side panels 16 and 18 are moved away from one another. The panel sections 15*a* and 15*b* unfold and simultaneously the panel sections 17*a* and 17*b* unfold as the side panels 16 and 18 are moved away from one another. After the side panels 15–18 are fully extended, the bottom panel 30 is pivoted onto the flanges 35. Should it be desired to heat a liquid, the disposable liner 40 is inserted into the cooking unit 10. A suitable removable handle, such as handle 45, is inserted into aligned openings in the side panels 15 and 17.

For retracting the cooking unit 10 into a collapsed state, the bottom panel 30 is pivoted into engagement with the inner wall of the side panel 16 by moving the bottom panel 30 inwardly away from the flanges 35. The top panel 70 is pivoted outwardly to engage the outer wall of the side panel 18. Then, the side panels 16 and 18 are moved toward one another. In moving the side panels 16 and 18 toward one another, the panel sections 15*a* and 15*b* fold inwardly.

Simultaneously, the panel sections 17*a* and 17*b* fold inwardly.

The hinges 25 and 26 are disposed adjacent one another in parallel relation, when the cooking unit 10 is in the collapsed state. When the cooking unit 10 is in a collapsed state, it may be stored in a fabric pouch 74 (FIG. 10).

The disposable liner 40 (FIGS. 7 and 8) may be purchased as a manufactured item or may be formed from a sheet of metal foil laminated with a high temperature nylon film (FIGS. 9A–9D). The sheet (FIGS. 9A–9D) is creased by folding corner a to corner c and by folding corner b to corner d (FIG. 9A). The creased sheet is unfolded (FIG. 9A). Sections B and D are folded simultaneously while sections A dnd C are folded inwardly along the previously formed creases (FIG. 9B). The apex of the triangular configuration is folded across a line e to form a section E (FIG. 9C). Lastly, the corners b and c are folded inwardly toward the front side and the corners c and d are folded inwardly toward the back side (FIG. 9D). The disposable liner 40 is now in the folded state. When placed in the cooking unit 10, the folded liner 40 is opened into an opened bag configuration and placed in the cooking unit with the closed end of the opened bag engaging the bottom panel 30 and the opened end of the bag extending along the side panels of the cooking unit.

Illustrated in FIG. 11 is a collapsible cooking unit 10' which is similar to the collapsible cooking unit 10 except that the collapsible cooking unit 10' is formed without the slot 50 in a side wall panel and a pivotal handle is provided to extend from the side wall panel. Components of the cooking unit 10', similar to the components of the cooking unit 10, are shown with the same reference numeral and a prime suffix. Side panel 75 is similar to side panel 16 but without the slot 50.

Secured to the side panel 75 at the upper section thereof by rivets is a channel member 76. The channel member 76 is hollow and has a U-shaped cross-sectional area. Formed in the lower section of the U-shaped channel member 76 is a slot 80. Formed in the legs of the channel member 76 are horizontally aligned holes 81 and 82.

A bail wire handle 85 is formed with a loop section 86 and oppositely directed free ends 87 and 88. By squeezing the loop section 86 to draw the free ends 87 and 88 toward one another, the free ends 87 and 88 enter the slot 80 and are removably disposed in the aligned openings 87 and 88, respectively, upon release of the loop section 86.

When the loop section 86 is juxtaposed with the panel 75, the walls 80*a* and 80*b* of the slot 80 inhibit pivotal movement of the loop section 86 away from the panel 75. By squeezing the loop 86 to draw the free ends 87 and 88 toward one another just beyond the walls 80*a* and 80*b*, the loop section 86 is pivoted away from the panel 75 to extend from the panel 75 and at right angles thereto. The loop section 86 is stopped by the horizontal wall surrounding the slot 80 to limit the loop section 86 to a movement at right angles to the panel 75. Recessed area within the vertical member of the U-shaped channel member 76 receives the ends of the loop section 86 when the loop section 86 projects at right angles from the side panel 75.

While the present invention has been described as a cooking unit, it is apparent that it may be employed to perform other operations, such as eating container, drinking container, and heating a liquid for purposes other than to serve as food.

I claim:

1. A heating unit for consumables comprising:

(a) a hollow vessel comprising a plurality of adjacent pairs of confronting side panels, each of said panels having a side edge and a bottom edge, each side panel of one of said pairs of said panels having adjacent sections, said adjacent sections of each side panel of said one pair of side panels having adjacent edges parallel to the side edges of said panels;

(b) first hinge means hingedly connecting adjacent side edges of said side panels for folding and extending said hollow vessel;

(c) second hinge means hingedly connecting adjacent sections of each side panel of said one pair of side panels for folding and extending said hollow vessel, (d) a bottom panel hingedly connected to the lower edge of a side panel other than the side panels of said one pair of said panels and engaging the bottom edges of said side panels other than the bottom edge of said side panel to which it is hingedly connected for forming a bottom wall for said hollow vessel, (e) a cover panel hingedly connected to the upper edge of a side panel that confronts the side panel to which said bottom panel is hingedly connected;

(f) said one pair of said panels being formed with an upper section and with confronting openings in the upper section thereof; and (g) a handle with free ends removably insertable in said openings and pivoted within said openings, said handle including a central section between said free ends arranged for suspending said hollow vessel.

2. A heating unit for consumable as claimed in claim 1 wherein a side panel other than the side panels of said one pair of side panels is formed with a slot in the upper section thereof generally parallel to the upper edge of said side panel in which it is formed, said handle being pivotal toward said slot and said central section of said handle being insertable within said slot and projecting away from said hollow vessel and said side panel in which said slot is formed for providing a handle for said hollow vessel projecting away from said hollow vessel and projecting away from said panel in which said slot is formed.

3. A collapsible heating unit for consumable comprising:

(a) a hollow vessel comprising a plurality of adjacent pairs of confronting side panels, each of said panels having a side edge and a bottom edge, each side panel of one of said pairs of said panels having adjacent sections, said adjacent sections of each side of said one pair of side panels having adjacent edges parallel to the side edges of said panels;

(b) first hinge means hingedly connecting adjacent side edges of said side panels for folding and extending said hollow vessel;

(c) second hinge means hingedly connecting adjacent sections of each side panel of said one pair of side panels for folding and extending said hollow vessel;

(d) a bottom panel hingedly connected to the lower edge of a side panel other than the side panels of said one pair of said panels and engaging the bottom edges of said side panels other than the bottom edge of said side panel to which it is hingedly connected for forming a bottom wall for said hollow vessel, (e) a side panel of said panels other than the side panel to which said bottom panel is hingedly connected being formed with a flange along the bottom edge thereof projecting inwardly within said vessel, said bottom panel at times being arranged to seat on said flange for bracing said side panels and at other times being arranged to pivot inwardly within said vessel to engage the side panel to which it is hinged in a generally parallel relation; and (f) a disposable liner bag for containing a consumable to be heated disposed in said vessel in engagement with the inner walls of said side panels, said disposable liner bag having a bottom wall engageable with said bottom panel and an open top in the vicinity of the top edges of said side panels, said disposable liner bag being made of a metallic foil, said disposable liner bag being laminated with a high temperature nylon film.

4. A heating unit for consumables comprising:

(a) a hollow vessel comprising a plurality of adjacent pairs of confronting side panels, each of said panels having a side edge and a bottom edge, each side panel of one of said pairs of said panels having adjacent sections, said adjacent sections of each side panel of said one pair of side panels having adjacent edges parallel to the side edges of said panels;

(b) first hinge means hingedly connecting adjacent side edges of said side panels for folding and extending said hollow vessel;

(c) second hinge means hingedly connecting adjacent sections of each side panel of said one pair of side panels for folding and extending said hollow vessel;

(d) a bottom panel hingedly connected to the lower edge of a side panel other than the side panels of said one pair of said panels and engaging the bottom edges of said side panels other than the bottom edge of said side panel to which it is hingedly connected for forming a bottom wall for said hollow vessel;

(e) a cover panel hingedly connected to the upper edge of a side panel that conforms the side panel to which said bottom panel is hingedly connected;

(f) a bail wire handle; and (g) attachment means mounted on a side panel other than the side panels of said one pair of side panels for supporting said bail wire handle for pivotal movement.

5. A heating unit for consumables as claimed in claim 4 wherein said bail wire handle includes oppositely directed free ends and a central section, and wherein said attachment means comprises a channel-shaped member with a plurality of aligned openings to receive said free ends of said bail wire handle for pivotal movement.

6. A heating unit for consumable as claimed in claim 5 wherein said channel-shaped member is formed with a slot as defined by spaced confronting walls to restrict the movement of said bail wire handle when said bail wire handle is disposed against the side panel on which said attachement means is mounted, movement of said free ends of said bail wire handle toward one another releases said bail wire handle from said spaced confronting walls enabling said bail wire handle to be pivoted away from said side panel on which said attachment means is mounted.

7. A heating unit for consumables as claimed in claim 6 wherein said slot is defined by a wall disposed above said spaced confronting walls joining said spaced confronting walls to limit the pivotal movement of said bail wire handle away from said side panel on which said attachment means is mounted.

* * * * *